US008960831B2

(12) United States Patent
Kaneko et al.

(10) Patent No.: US 8,960,831 B2
(45) Date of Patent: Feb. 24, 2015

(54) INKJET HEAD AND AN INKJET RECORDING DEVICE

(71) Applicant: Toshiba Tec Kabushiki Kaisha, Tokyo (JP)

(72) Inventors: Yoshiaki Kaneko, Shizuoka (JP); Takashi Kado, Shizuoka (JP); Masashi Hiroki, Kanagawa (JP); Atsushi Kubota, Shizuoka (JP); Takao Izumi, Kanagawa (JP); Takaya Kitawaki, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 52 days.

(21) Appl. No.: 13/733,010

(22) Filed: Jan. 2, 2013

(65) Prior Publication Data

US 2013/0182024 A1 Jul. 18, 2013

(30) Foreign Application Priority Data

Jan. 12, 2012 (JP) ..... 2012-004360

(51) Int. Cl.
*B41J 29/38* (2006.01)
*B41J 2/045* (2006.01)
*B41J 19/20* (2006.01)

(52) U.S. Cl.
CPC ..... *B41J 2/04588* (2013.01); *B41J 19/202* (2013.01); *B41J 2/04563* (2013.01); *B41J 2/04573* (2013.01); *B41J 2/04581* (2013.01); *B41J 2/04595* (2013.01)
USPC ..... 347/10; 347/11

(58) Field of Classification Search
CPC ..... B41J 2/04581; B41J 2/04588; B41J 2/04541; B41J 2/04593
USPC ..... 347/10, 11
See application file for complete search history.

(56) References Cited

U.S. PATENT DOCUMENTS

2002/0089558 A1* 7/2002 Suzuki et al. ..... 347/10
2009/0322823 A1* 12/2009 Ito et al. ..... 347/20
2011/0279502 A1 11/2011 Kaneko et al.

FOREIGN PATENT DOCUMENTS

JP 2008-049713 3/2008
JP 2009-154493 7/2009

OTHER PUBLICATIONS

Office Action dated Apr. 1, 2014, filed in Japanese Patent Application No. 2012-004360, with English translation.

* cited by examiner

*Primary Examiner* — Manish S Shah
*Assistant Examiner* — Yaovi Ameh
(74) *Attorney, Agent, or Firm* — Patterson & Sheridan LLP

(57) ABSTRACT

According to one embodiment, the inkjet head of an application example includes a pressure chamber for charging the ink, an actuator for changing the volume of the pressure chamber, a nozzle for discharging the ink inside the pressure chamber when the volume of the pressure chamber is changed, and a controller that, in the formation of one pixel by discharging ink drops from the nozzle, when the elapsed interval from discharging ink drops last time by the nozzle is less than the specified interval, outputs the discharging waveform corresponding to the ink drop number determined for the formation of the pixel, and when the elapsed interval is more than the specified interval, increases the number of ink drop discharge cycles above the number determined for the formation of the pixel.

19 Claims, 7 Drawing Sheets

INKJET HEAD AND AN INKJET RECORDING DEVICE

CROSS-REFERENCE TO RELATED APPLICATION

This application is based upon and claims the benefit of priority from Japanese Patent Application No. 2012-004360, filed Jan. 12, 2012; the entire contents of which are incorporated herein by reference.

FIELD

Embodiments described herein relates to an inkjet head for discharging an ink to a recording medium for the formation of a picture image and an inkjet recording device provided with the head.

BACKGROUND

Inkjet heads used in an inkjet mode recording device, or the like, form a picture image on a recording medium by selectively discharging ink from a plurality of nozzles. Conventionally, so-called multi drop mode technology is used for the formation of a high gradation picture image. This multi drop mode technology involves changing the number of ink drops used for the formation of one pixel.

In order to obtain a good picture quality by using an inkjet head, it is necessary to maintain good ink discharging performance from the nozzle(s). However, during printing, if a low ink discharge frequency is used, there is a concern about poor ink discharge performance because of an increase in viscosity of the ink due to drying. That is, when the frequency of ink discharge is low, the viscosity of the ink may increased by drying of the ink at the air-ink meniscus (interface) inside the nozzle. If the ink viscosity increases, then the nozzle may be unable to obtain the desired ink discharge volume. Thus, in multi-drop mode if ink discharge frequency is low due to the requirements of generating a high gradation image, then ink drying (increasing viscosity) in the nozzle may be a problem.

A problem presented in the prior art is thus to improve the ink discharging performance of the nozzle and while still being capable of obtaining good picture quality.

DETAILED DESCRIPTION

In general, explanation of embodiments of the present disclosure will be given in the following paragraphs with reference to the drawings.

The inkjet head according to an embodiment is provided with a pressure chamber for storing an ink charge, an actuator for changing the volume of the pressure chamber according to an inputted discharging waveform, a nozzle for discharging the ink charge from the pressure chamber when the actuator changes the volume of the pressure chamber in response to the discharging waveform input into the actuator, and a controller that during the printing of a pixel by discharging ink drops from the nozzle controls as follow: when the elapsed interval from the last discharging of an ink drop from the nozzle is less than a specified time/interval the discharging waveform is determined on the basis of the gradation value data of the pixel to be printed such that the number of times the actuator is triggered is in accordance with the gradation value of the pixel, and when the elapsed time is greater than the specified time/interval the discharging waveform is adjusted such that the number of times the actuator is triggered is increased to a number greater than the number which would be solely in accordance with the gradation value of the pixel to be printed.

First Embodiment

Figure 1:
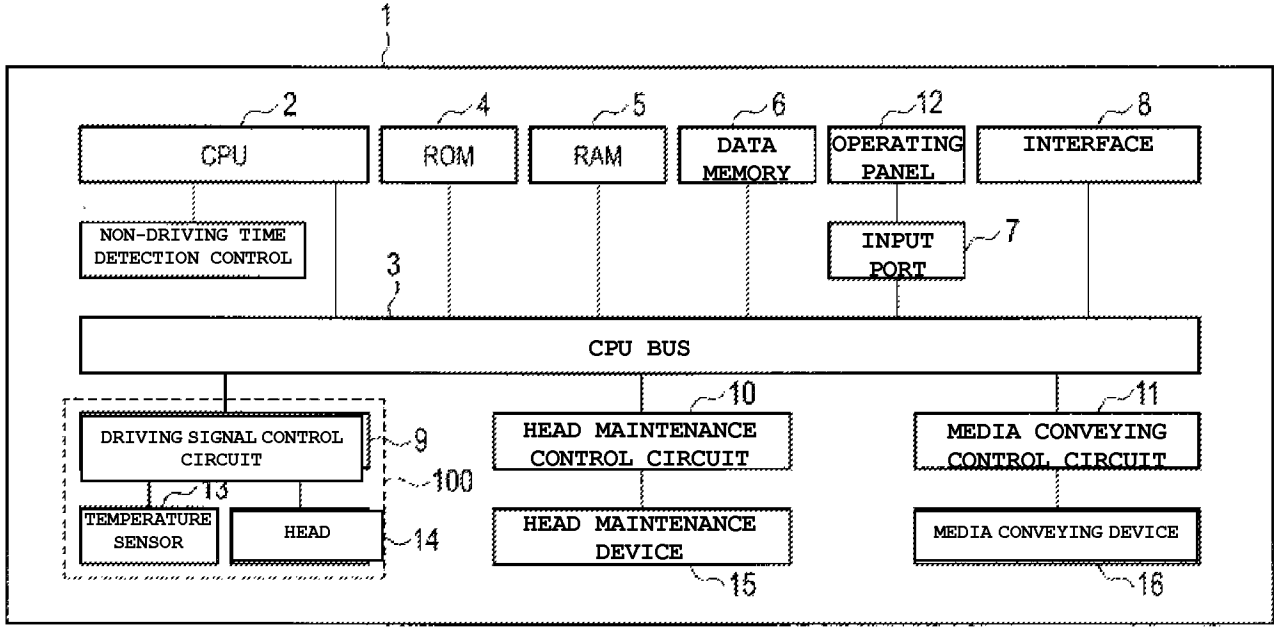
FIG. 1 is a diagram showing the major components of the inkjet recording device according to a first embodiment.

FIG. 1 is a block diagram showing the major part constitution of the inkjet recording device (1) according to a first embodiment.

The inkjet recording device (1) according the present embodiment is equipped with the CPU (Central Processing Unit) (2) that functions as the center of control. To this CPU (2), via the CPU bus (3), the ROM (Read Only Memory) (4), the RAM (Random Access Memory) (5), the data memory (6), the input port (7), the interface (8), the driving signal control circuit (9) (controller), the head maintenance control circuit (10), the media conveying control circuit (11) and so on are connected. Furthermore, the operating panel (12) is connected to the input port (7), the temperature sensor (13) and the head (14) are connected to the driving signal control circuit (9), the head maintenance device (15) is connected to the head maintenance control circuit (10), and the media conveying device (16) (conveying device) is connected to the media conveying control circuit (11).

The CPU (2) carries out a variety of processing with regard to the control of the inkjet recording device (1). Furthermore, the CPU (2) carries out the non-driving time detection control to be described later in the explanation of FIG. 5.

The ROM (4) stores the control programs for carrying out various types of processing executed by CPU (2), or fixed values for use in the processing. In the RAM (5), depending on the processing needs, various types of working storage areas are formed.

The data memory (6) stores, for example, the picture image data inputted from external inkjet recording device (1), or deployment data, which is the assembly of the gradation value data by converting various pixels contained in this picture image data into the discharge frequency of ink drops.

The operating panel (12) is constituted by a display attached with various operating buttons or a touch panel, used for inputting the information related to the beginning of printing, setting of the printing conditions and so on and, at the same time, informs the control state of the inkjet recording device (1) by display on the display.

On the interface (8), for example, a cable or the like for communication with a host computer or other external machines is connected.

The driving signal control circuit (9), the temperature sensor (13) and the head (14) constitute the inkjet head (100) according to the present embodiment. The details of the driving signal control circuit (9), the temperature sensor (13) and the head (14) will be described later by the explanation of FIGS. 2 and 3.

The head maintenance device (15) moves toward the head (14) and cleans the nozzle face of the head (14). The head maintenance control circuit (10) controls the head maintenance device (15).

The media conveying device (16) is constituted by, for example, a pickup roller for picking up the paper as the recording medium received in the paper cassette not shown in the drawing, an adsorption drum for adsorbing the paper picked up by the roller to the circumferential side and conveying it to the ink discharge position by the head (14), a peeling off mechanism for peeling off the paper after the formation of a picture image by the head (14) from the drum, a paper discharge roller for discharging paper to a paper discharging tray not shown in the drawing for the paper peeled off by the peeling off mechanism, and so on. The media conveying control circuit (11) controls the various sections equipped with the media conveying device (16).

Next, an explanation will be given with regard to the details of the various sections constituting the inkjet head (100).

Figure 2:
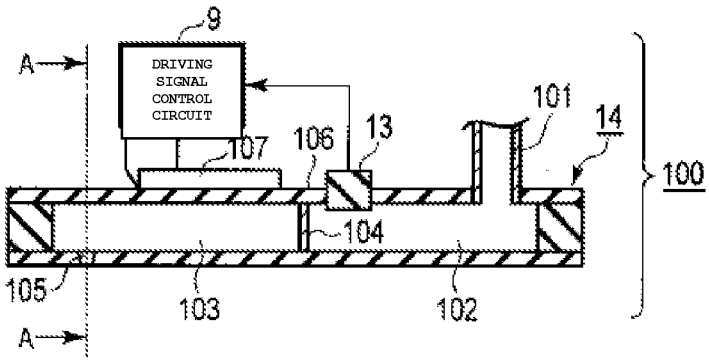
FIG. 2 is a diagram showing the components of the inkjet head according to the first embodiment.

As shown in the cross-sectional drawing of FIG. 2, the head (14) is equipped with the ink flow inlet (101) connected to an ink cartridge or other ink supply sources, the common pressure chamber (102) accommodating the ink flowing into this ink flow inlet (101), a plurality of pressure chambers (103) for storing ink charges from the common pressure chamber (102), the diaphragm (104) for partitioning pressure chambers (103) and the common pressure chamber (102), a plurality of nozzles (105) for discharging ink from each respective pressure chambers (103), a plurality of vibration plates (106) for forming one wall surface of the various pressure chambers (103), a plurality of piezoelectric elements (107) respectively installed on these vibration plates (106). The aforementioned temperature sensor (13) is provided at a position capable of detecting the temperature of the ink inside the common pressure chamber (102). The aforementioned driving signal control circuit (9) is connected to the vibration plates (106) and the temperature sensor (13).

Figure 3:
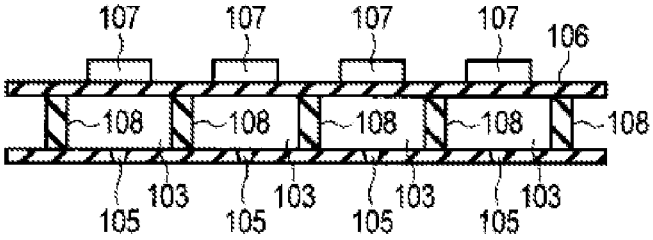
FIG. 3 is the A-A cross-sectional diagram of FIG. 2.

The cross section seen along the A-A line of FIG. 2 in the arrow direction is FIG. 3. In other words, the various pressure chambers (103) are adjacent to each other via the respective diaphragms (108).

A plurality of actuators for changing the volumes of the various pressure chambers (103) are constituted by the various vibration plates (106) and the various respective piezoelectric elements (107). If the volume of the pressure chamber (103) is expanded, the ink from inside the common pressure chamber (102) is introduced into the pressure chamber (103). When the volume of the pressure chamber (103) is decreased from the expanded state, the ink inside the pressure chamber (103) is discharged as an ink drop from the corresponding nozzle (105).

Figure 4:
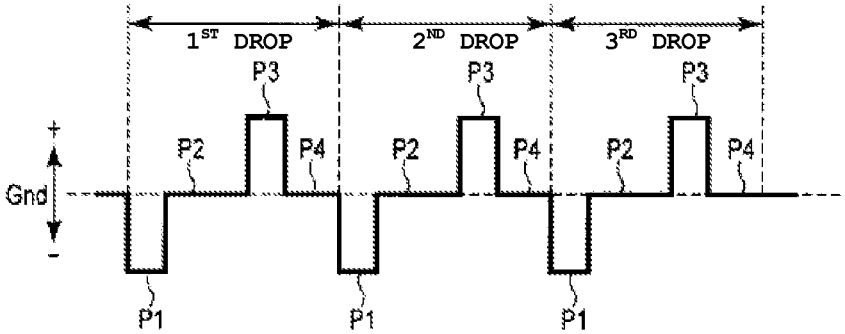
FIG. 4 is a diagram showing the discharging waveform according to the first embodiment.

The driving signal control circuit (9), as shown in FIG. 4, outputs to the various actuators a waveform voltage containing in sequence the expansion pulse P1 for expanding the volume of the pressure chamber (103), the ground potential (pulse pause) P2 for allowing the pressure chamber 103 to equilibrate after the expansion pulse P1, the shrinkage (contraction) pulse P3 for decreasing/shrinking the volume of the pressure chamber (103), and the ground potential (pulse pause) P4 allowing for the pressure chamber 103 to equilibrate after the shrinkage (contraction) pulse P3.

A discharging waveform for the discharging of one ink drop is constituted by the expansion pulse P1, the ground potential P2, the shrinkage (contraction) pulse P3, and the ground potential P4.

A multi drop mode is adopted in this embodiment. In an example multi drop mode, one printed pixel is formed on the paper by outputting this discharging waveform to the same actuator up to a maximum of three times. In doing so, using just one inkjet print head (14), the printed picture image formed may have four different pixel gradations (i.e., 0 drop, 1 drop, 2 drops, and 3 drops). FIG. 4 shows a discharging waveform for a three drop gradation—that is, dispensing three drops in sequence (drops 1-3) to form a printed pixel.

As depicted, the expansion pulse P1 is negative in polarity and the shrinkage (contraction) pulse P3 is positive in polarity. However, it is also acceptable to constitute the actuator so that the expansion pulse P1 and the shrinkage (contraction) pulse P3 are reversed in polarity such that the volume of the pressure chamber (103) is expanded by the expansion pulse P1 positive in polarity, and the volume of the pressure chamber (103) is shrunk by the shrinkage (contraction) pulse P3 negative in polarity.

During the period of the expansion pulse P1, the volume of the pressure chamber (103) is expanded and the ink from inside the common pressure chamber (102) is introduced into the pressure chamber (103). In the period of the ground potential P2, the volume of the pressure chamber (103) is returned from the expansion by the expansion pulse P1 to a steady state. And the ink inside the pressure chamber (103) is discharged from nozzle (105) during the period of the shrinkage pulse P3 when the volume of the pressure chamber (103) is shrunk. In the period of the ground potential P4, the volume of the pressure chamber (103) is returned from the shrinkage caused by the shrinkage pulse P3 to a steady state. By including this pause after the shrinkage pulse the vibration of the ink inside the pressure chamber (103) is suppressed/reduced.

Taking the intrinsic vibration period AL of the ink and other inkjet head elements into consideration, the periods of the expansion pulse P1, the ground potential P2, the shrinkage pulse P3 and the ground potential P4 may be set in with periods allowing the suppression of the vibration of the ink inside the pressure chamber (103) after the ink drop discharging.

Next, an explanation will be given with regard to the processing for picture image formation in the present embodiment.

If, for example, picture image formation is instructed by a host computer or other external machines via the interface (8), the CPU (2) stores the picture image data input from the external machines in the data memory (6). Furthermore, the CPU (2) forms the deployment data by conversion of the various pixels contained in the picture image data stored in the data memory (6) into the gradation value data of 0-3 drops and stores the deployment data in the data memory (6).

On the basis of the deployment data in the data memory (6), the picture image is formed on the paper. In other words, the media conveying control circuit (11) controls the media conveying device (16) to pick up the paper from the paper supplying cassette and, at the same time, to convey the paper to the nozzle face of the head (14). In correspondence with the conveyance of the paper, the driving signal control circuit (9), in the sequence from the lead line of the deployment data stored in the data memory (6), supplies the driving voltage signals including the discharging waveform for the number of drops corresponding to the gradation value data of the various pixels contained in various lines to the respective corresponding piezoelectric elements (107) (which, along with vibration plates 106, form actuators).

In the formation of one pixel on the paper in such processing, when the elapsed time (hereafter, "the non-driving time T") between the discharging of ink drops from a nozzle (105) is less than a specified time T1, the driving signal control circuit (9) outputs the discharging waveform to the piezoelectric element (107) only based on the gradation value data of the pixel, and when the non-driving time T (time between drop discharges) is greater than the specified time T1, adjusts the discharging waveform output to the piezoelectric element (107) to include two additional discharge pulse cycles above the number of corresponding to the number of ink drops (above zero) shown in the gradation value data of the pixel to for the formation of the pixel. It should be noted that the number of additional discharge cycles can be one, more than three or more than one, instead of two, which is only an example.

Figure 5:
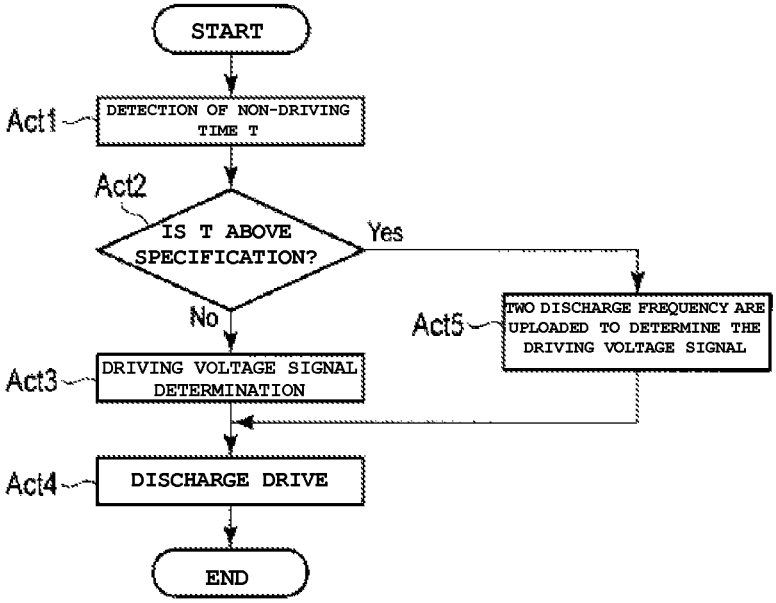
FIG. 5 is a flowchart depicting the actions according to the first embodiment.
Figure 6:
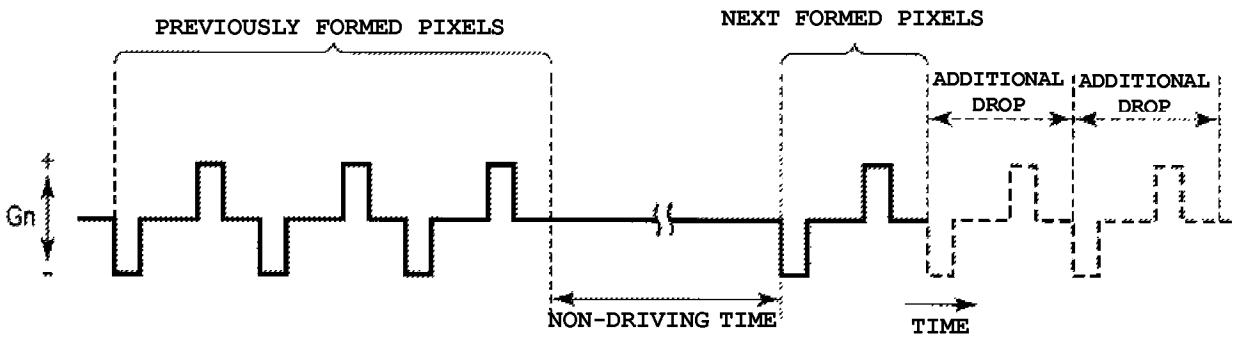
FIG. 6 is a diagram showing a waveform example of the driving voltage signal according to the first embodiment.

An explanation of details of this action will be given by using the flowchart shown in FIG. 5 and the waveform example of the driving voltage signal shown in FIG. 6. As shown in FIG. 5, in the formation of one pixel (hereafter, "the next formation pixel"), first of all, the CPU (2) carries out the non-driving time detection control, and the non-driving time T of the nozzle (105) corresponding to the next formation pixel is detected (Act 1). The non-driving time T is the time, for example, as shown in FIG. 6, from the time of the outputting, by the driving signal control circuit (9), of the last ground potential P4 contained in the discharging waveform corresponding to the pixel (hereafter, "the last formation pixel") formed last time by the nozzle (105) to the outputting, by the driving signal control circuit (9), of the expansion pulse P1 as the lead of the next formation pixel. It is detected by reference to the time counted with, for example, a timer or the like provided with the CPU (2).

After Act 1, the CPU (2) outputs the detected non-driving time T to the driving signal control circuit (9). Then, the driving signal control circuit (9) judges whether or not the non-driving time T is more than the specified time T1 (Act 2). The specified time T1 is a threshold value separating the cases where the number discharge cycles of ink drops for a pixel are increased above the number indicated by the pixel gradation value and the case where the discharge cycles are based simply on the pixel gradation value. The value for specified time T1 is determined from experience, experiment, or theory, and stored beforehand in the ROM (4) or the like. The value may vary based on such things as ink chemistry, nozzle design, ink age, etc. Furthermore, in view of the fact that the viscosity of the ink changes with temperature, it is also contemplated that the specified time T1 may be changed dynamically according to the temperature detected by the temperature sensor (13). In this case, for example, if the temperature detected by the temperature sensor (13) is high, the specified time T1 can be extended. If the same temperature is low, the specified time T1 can be shortened.

If the non-driving time T is less than the specified time T1 (T<T1) (No of Act 2), the driving signal control circuit (9) determines the signal for discharging waveform as the driving voltage signal for the formation of the next pixel only by reference to the gradation value data of the next formation pixel memorized in the memory data (6) (Act 3). Then, the driving signal control circuit (9) outputs the determined driving voltage signal to the piezoelectric element (107) corresponding to the next formation pixel, and ink drops of only the number of discharging cycles contained in the driving voltage signal are discharged from the nozzle (105) (Act 4).

On the other hand, if in Act 2 the non-driving time T is more than the specified time T1 (T≥T1) (Yes of Act 2), the driving signal control circuit (9) determines the signal of the discharging waveform by increasing the number of discharge cycles by two above the number (above zero) indicated by the gradation value data of the next formation pixel memorized in the memory data (6) as the driving voltage signal for the formation of the next formation pixel (Act 5). Then, the driving signal control circuit (9) outputs the determined driving voltage signal to the piezoelectric element (107) corresponding to the next formation pixel, and ink drops of the number of discharging cycles contained in the driving voltage signal are discharged from the nozzle (105) corresponding to the piezoelectric element (107) (Act 4).

The action for the formation of one pixel on the paper is completed by using Act 4.

In FIG. 6, two discharging cycles (additional drops) added to the discharging waveform based on the number of cycles indicated by the gradation value in the manner described above are shown by dashed lines. In other words, in the case in which the discharge frequency of ink drops shown by the gradation value data of the next formation pixel memorized in the memory data (6) is one drop, if the non-driving time T is less than the specified time T1, as shown by the solid line, the driving voltage signal constituted by one discharging waveform is outputted to the corresponding piezoelectric element (107). If the non-driving time T is more than the specified time T1, as shown by the solid line and the dashed line, the driving voltage signal constituted by three (one dropper the gradation value and two drops per the adjustment due to the time between drop discharges exceeding specified time T1) discharging waveforms is outputted to the corresponding piezoelectric element (107).

By carrying out in sequence the actions according to the nozzle (105) in the manner described above, the pixels of the one line portion are formed on the paper. Furthermore, by repeating the same procedure with regard to all lines constituting the deployment data, one page of pixel formation is completed and the image is printed on the paper. If the discharge frequency of ink drops shown by the gradation value data of the next formation pixel memorized in the memory data (6) is "0," the actions shown in the flowchart of FIG. 5 with regard to the pixel are not carried out. In other words, with regard to the pixel with the discharge frequency of ink drops shown by the gradation value data being "0," non-discharging is maintained irrespective of the non-driving time T.

As explained above, in the present embodiment, with respect to the pixel with the non-driving time T being more than the specified time T1, the number of ink drops is increased. With such a constitution, even in the case in which the ink discharge frequency is decreased allowing the meniscus of the ink inside the nozzle (105) to dry, which results in an increase in viscosity, the ink can still be discharged at an appropriate volume and an appropriate rate, and a good picture quality can be obtained.

Second Embodiment

Next, an explanation will be given with regard to a second embodiment.

Figure 7:
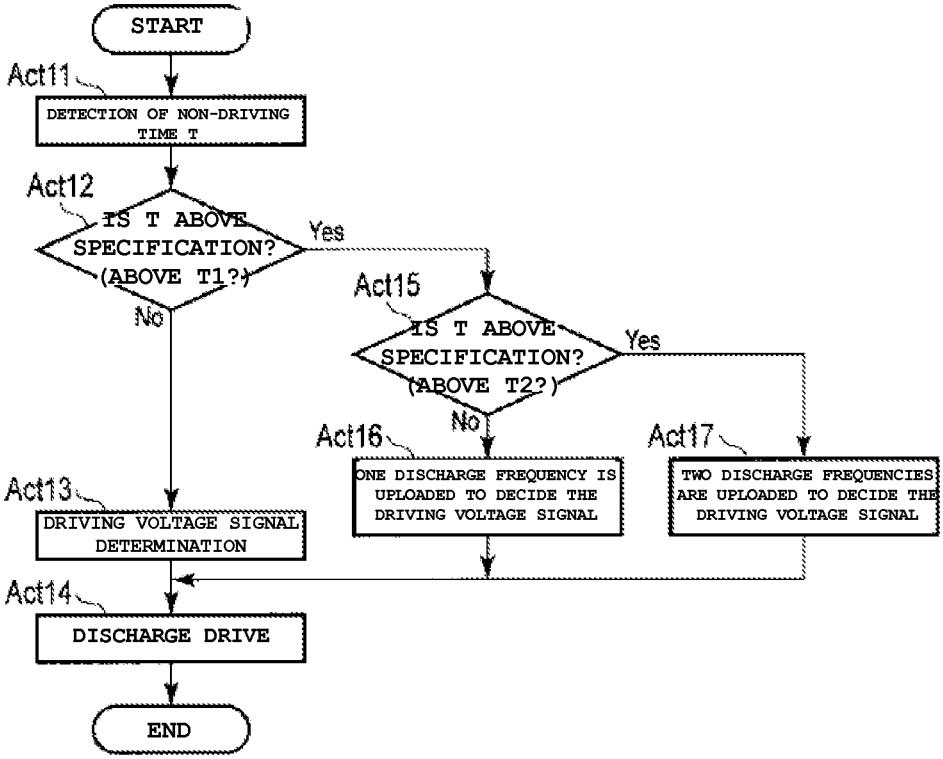
FIG. 7 is a flowchart for depicting the actions according to a second embodiment.

In the present example, one pixel is formed by carrying out the actions shown in the flowchart of FIG. 7 instead of the actions shown in the flowchart of FIG. 5. The constitutions of the inkjet recording device (1), the inkjet head (100), and the driving voltage signal are the same as those shown in FIGS. 1 to 4.

In the flowchart of FIG. 7, first of all, the CPU (2) detects the non-driving time T (Act 11) in the same manner as in Act 1. Then, the driving signal control circuit (9), in the same manner as in Act 2, judges whether or not the non-driving time T is more than the specified time T1 (Act 12).

If the non-driving time T is less than the specified time T1 (T<T1) (No of Act 12), the driving signal control circuit (9), in the same manner as in Act 3, determines the signal for the discharging waveform as the driving voltage signal for the formation of the next formation pixel based on the number of ink drops shown by the gradation value data (Act 13). In the same manner as in Act 4, the determined driving voltage signal is outputted to the piezoelectric element (107) corresponding to the next formation pixel, and ink drops of only the number of discharging waveforms contained in the driving voltage signal are discharged from the nozzle (105) (Act 14).

On the other hand, in Act 12, if the non-driving time T is more than the specified time T1 (T≥T1) (Yes of Act 12), the driving signal control circuit (9) additionally judges whether or not the non-driving time T is more than a specified time T2 (Act 15). The specified time T2 is set at a longer time than the specified time T1 (T2>T1) and is stored beforehand together with the specified time T1 in the ROM 4 or the like. It is also contemplated that the value of this specified time T2 can be changed dynamically according to the temperature detected by the temperature sensor (13) in a similar manner as the specified time T1. In this case, for example, in the range not lower than the specified time T1, if the temperature detected by the temperature sensor (13) is high, the specified time T2 can be extended. If the same temperature is low, the specified time T2 can be shortened.

If the non-driving time T is less than the specified time T2 but greater than or equal to specified time T1(T1≤T<T2) (No of Act 15), the driving signal control circuit (9) increases the number of discharge cycles included in the driving signal by one above the number of discharge cycles (above zero) indicated by the gradation value data of the next formation pixel stored in the memory data (6) (Act 16). Then, the driving signal control circuit (9) outputs the determined driving voltage signal to the piezoelectric element (107) corresponding to the next formation pixel, and ink drops corresponding to the number of discharging waveforms contained in the driving voltage signal are discharged from the nozzle (105) (Act 14).

On the other hand, if the non-driving time T is more than the specified time T2 (T2≤T) (Yes of Act 15), the driving signal control circuit (9) increases the number of discharge cycles included in the driving signal by two above the number of discharge cycles (above zero) indicated by the gradation value data of the next formation pixel memorized in the memory data (6) (Act 17). Then, the driving signal control circuit (9) outputs the determined driving voltage signal to the piezoelectric element (107) corresponding to the next formation pixel, and ink drops of corresponding to the number of discharging waveforms contained in the driving voltage signal are discharged from the nozzle (105) (Act 14). The number uploaded in the Act 16 can also be more than 3 instead of 2, and the number uploaded in the Act 17 can also be more than 3 if it is specified in a range not less than the number uploaded in the Act 16.

The action for the formation of one pixel on the paper is completed by using Act 14.

In this manner, in the present embodiment, in the case in which the non-driving time T is more than the specified time T1, the number of discharge cycles added to the discharge signal shown with the gradation value data is changed in stages according to the non-driving time T. With such a constitution, the adjustments to discharge frequency corresponding to the situation of the individual nozzles (105) can be made. These adjustments provide ink at an amount close to the discharging volume of the ink volume originally required from the various nozzles (105), and the various pixels can thus be formed.

Third Embodiment

Next, an explanation will be given with regard to the third embodiment.

Figure 8:
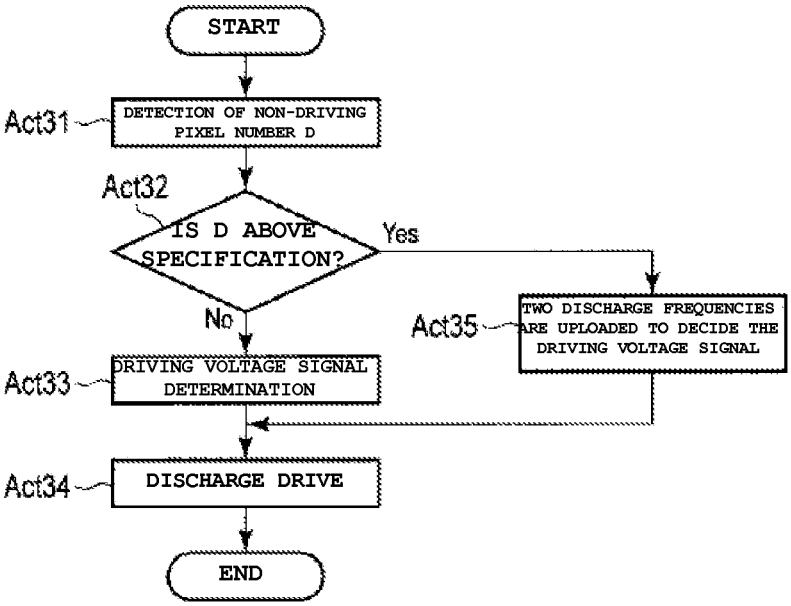
FIG. 8 is a flowchart depicting the actions according to a third embodiment.

In the present embodiment, one pixel is formed by carrying out the actions shown in the flowchart of FIG. 8 instead of the actions shown in the flowchart of FIG. 5. The constitutions of the inkjet recording device (1), the inkjet head (100), and the driving voltage signal are the same as those shown in FIGS. 1 to 4. However, the CPU (2) carries out the non-driving pixel detection control instead of the non-driving time detection control.

In the present example, as shown in FIG. 8, in the formation of one pixel (the next formation pixel hereafter) on the paper, first of all, the CPU (2) carries out the non-driving pixel detection control and, with reference to the deployment data stored in the data memory (6), the non-driving pixel number D of the nozzle (105) for the next formation pixel is detected (Act 31). The non-driving pixel number D is the number of the pixels with zero drop discharge (0 drop) for the gradation value present between the pixel last formed by discharging ink from the nozzle (105) (the last formation pixel) and the next formation pixel.

Figure 9:
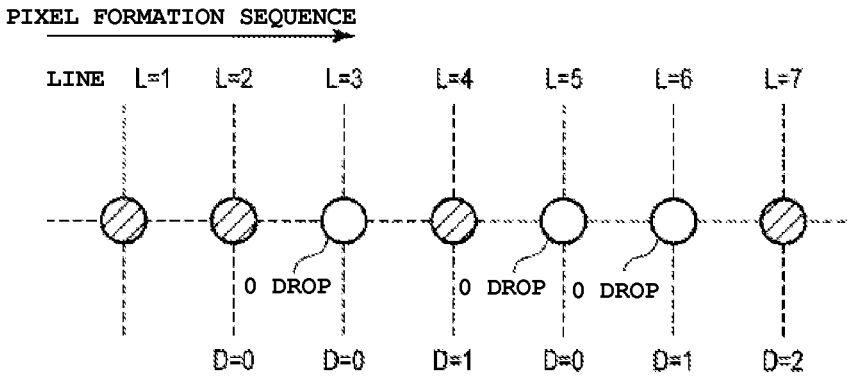
FIG. 9 is a diagram depicting the non-driving pixel number according to the third embodiment.

A detailed explanation will be given with regard to the non-driving pixel number D. FIG. 9 shows the pixel group (equivalent to a column) formed on the paper with the nozzle (105). The pixels with depicted with slant line shading represent the pixels with a gradation value with any one of values of 1-3 drops, and the pixels depicted without slant lines represent the pixels with a gradation value of zero (0 drop). The various pixels are included in lines of the lines L=1, 2, 3, . . . 7 in sequence from the left end, and are formed in this sequence on the paper. In this example, when the pixel of the line L=2 is the next formation pixel, the last formation pixel will be the pixel of the line L=1 and the non-driving pixel number D=0. In the same manner, when the pixels of the lines L=3 or L=5 are the next formation pixels, the last formation pixels will be respectively the pixels of the lines L=2 or L=4 and the non-driving pixel number D=0. Furthermore, when the pixels of the lines L=4 or L=6 are the next formation pixels, the last formation pixels will be respectively the pixels of the lines L=2 and L=4 and the non-driving pixel number D=1. Furthermore, when the pixel of the line L=7 is the next formation pixel, the last formation pixel will be the pixel of the line L=4 and the non-driving pixel number D=2.

After the Act 31, the CPU (2) outputs the detected non-driving pixel number D to the non-driving signal control circuit (9). Then, the non-driving signal control circuit (9) judges whether or not the non-driving pixel number D is more than a specified number D1 (Act 32). The specified number D1 is a threshold value separating the case with adjustments to the number of discharge cycles for ink drops and the case without. The specified number D1 may be determined from experience, experiment, or theory, and stored beforehand in the ROM (4) or the like. Furthermore, in view of the fact that the viscosity of the ink changes with temperature, it is also contemplated that the specified number D1 may be changed dynamically according to the temperature detected by the temperature sensor (13). In this case, for example, if the temperature detected by the temperature sensor (13) is high, the specified number D1 can be increased. If the same temperature is low, the specified number D1 can be decreased.

If the non-driving pixel number D is less than the specified number D1 (D<D1) (No of Act 32), in the same manner as the Act 3, the driving signal control circuit (9) determines the driving voltage signal for the discharge of ink drops as indicated by the gradation value data of the next formation pixel stored in the memory data (6) (Act 33). In the same manner as the Act 4, the determined driving voltage signal is outputted to the piezoelectric element (107) corresponding to the next formation pixel, and ink drops of only the number of discharging waveforms contained in the driving voltage signal are discharged from the nozzle (105) corresponding to the piezoelectric element (107) (Act 34).

On the other hand, in the Act 32, if the non-driving pixel number D is more than the specified number D1 (D≥D1) (Yes of Act 32), the driving signal control circuit (9) determines the driving voltage signal by adding two discharge cycles to the discharging waveform indicated by the gradation value (above zero) of the next formation pixel stored in the memory data (6) similar to Act 5 (Act 35). The number of added drops/discharge cycles can be one, more than three or more than one instead of two. After the Act 35, the driving signal control circuit (9) outputs the determined driving voltage signal to the piezoelectric element (107) corresponding to the next formation pixel, and ink drops of corresponding the number of discharging cycles contained in the driving voltage signal are discharged from the nozzle (105) (Act 34).

The action for the formation of one pixel on the paper is completed by using Act 34.

By carrying out in sequence the actions in the manner described above, the pixels of the one line portion are formed on the paper. Furthermore, by repeating the same procedure with regard to all lines constituting the deployment data, one page of the pixel formation is completed. If the discharge frequency of ink drops shown by the gradation value data of the next formation pixel memorized in the memory data (6) is "0," the actions shown in the flowchart of FIG. 8 with regard to the pixel are not carried out. In other words, with regard to the pixel with the discharge frequency of ink drops shown by the gradation value data being "0," non-discharging is maintained irrespective of the non-driving pixel number D.

As explained above, for the inkjet head (100) or the inkjet recording device (1) according to the present embodiment, with respect to the pixel with the non-driving pixel number D being more than the specified number D1, the number of ink drops is uploaded. Even with such a constitution, in the same manner as in the first embodiment, since the number of drops of the nozzle (105) low in the ink discharge frequency can be increased, a good picture quality can be obtained.

Fourth Embodiment

Next, an explanation will be given with regard to the fourth embodiment.

Figure 10:
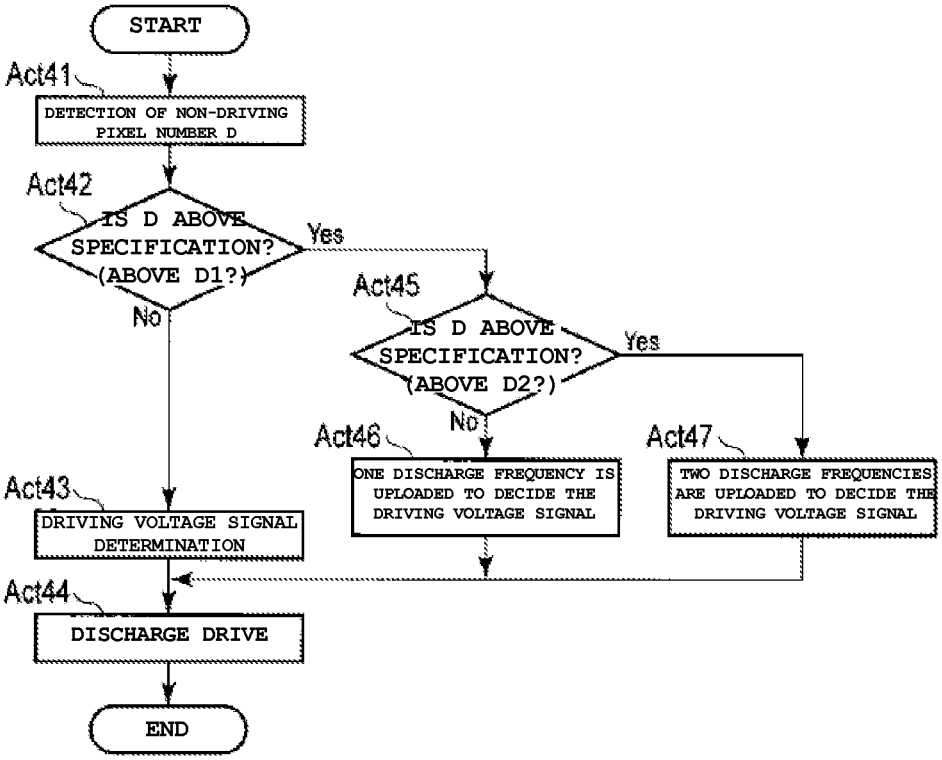
FIG. 10 is a flowchart depicting the actions according to a fourth embodiment.

In the present example, one pixel is formed by carrying out the actions shown in the flowchart of FIG. 10 instead of the actions shown in the flowchart of FIG. 8. The constitutions of the inkjet recording device (1), the inkjet head (100), and the driving voltage signal are the same as those shown in FIGS. 1 to 4. However, the CPU (2) carries out the non-driving pixel detection control in the same manner as in the third embodiment instead of the non-driving time detection control.

In the flowchart of FIG. 10, first of all, the CPU (2) detects the non-driving pixel number D (Act 41) in the same manner as in the Act 31. The driving signal control circuit (9) judges whether or not the non-driving pixel number D is more than the specified number D1 (Act 42) in the same manner as in the Act 32.

If the non-driving pixel number D is less than the specified number D1 (D<D1) (No of Act 42), in the same manner as the Act 33, the driving signal control circuit (9) determines the discharging voltage signal for the next pixel formation as indicated by the gradation value data of the next formation pixel stored in the memory data (6) (Act 43). In the same manner as the Act 34, the determined driving voltage signal is outputted to the piezoelectric element (107) corresponding to the next formation pixel, and ink drops of only the number of discharging waveforms contained in the driving voltage signal are discharged from the nozzle (105) corresponding to the piezoelectric element (107) (Act 44).

On the other hand, in the Act 42, if the non-driving pixel number D is more than the specified number D1 (D≥D1) (Yes of Act 42), the driving signal control circuit (9) determines whether or not the non-driving pixel number D is more than a specified number D2 (Act 45). The specified number D2 is set at a value larger than the specified number D1 (D2>D1) and stored beforehand together with the specified number D1 in the ROM 4 or the like. It is also contemplated that the value of this specified number D2 can be changed dynamically according to the temperature detected by the temperature sensor (13) in a manner similar to the specified number D1. In this case, for example, in the range not lower than the specified number D1, if the temperature detected by the temperature sensor (13) is high, the specified number D2 can be increased. If the same temperature is low, the specified number D2 can be decreased.

If the non-driving pixel number D is less than the specified number D2 (D1≤D<D2) (No of Act 45), the driving signal control circuit (9) increases the number of discharge cycles in the driving signal voltage for the next formation pixel by one above the value (above zero) indicated the gradation value data (Act 46). Then, the driving signal control circuit (9) outputs the determined driving voltage signal to the piezoelectric element (107) corresponding to the next formation pixel, and ink drops of corresponding to the number of discharging cycles contained in the driving voltage signal are discharged from the nozzle (105) (Act 44).

On the other hand, if the non-driving pixel number D is more than the specified number D2 (D2≤D) (Yes of Act 45), the driving signal control circuit (9) increases the number of discharge cycles for the next formation pixel included in the driving voltage signal by two more than indicated by the gradation value (above zero) stored in the memory data (6) (Act 47). Then, the driving signal control circuit (9) outputs the determined driving voltage signal to the piezoelectric element (107) corresponding to the next formation pixel, and ink drops of corresponding to the number of discharging cycles contained in the driving voltage signal are discharged from the nozzle (105) (Act 44). The number of added discharge cycles in the Act 46 can also be more than 3 instead of 2, and the number in the Act 47 can also be more than 3 if it is specified in a range not less than the number of cycles added in the Act 46.

The action for the formation of one pixel on the paper is completed by using Act 44.

In this manner, in the present embodiment, in the case in which the non-driving pixel number D is more than the specified number D1, the number of discharge cycles is changed in stage according to the non-driving number D. With such a constitution, in the same manner as in the second embodiment, an appropriate number of drops corresponding to the situation of the individual nozzles (105) can be provided to the paper. The ink at an amount close to the discharging volume of the ink originally required is discharged from the various nozzles (105), and the various pixels can be formed.

Additional Examples

The example embodiments described above can be modified to incorporate various elements of each example and the various embodiments may be implemented in various stages of an embodiment of the various constituent elements.

For example, in the various embodiments described above, the case for the formation of the pixels of with four gradation values corresponding to the number of drops of ink discharging from one nozzle (105) has been exemplified. However, in the case of the formation of the pixels the number of drops used in the gradation scheme may be less than 3 or more than 5 from one nozzle (105).

Furthermore, in the second and fourth embodiments, the cases of changing the numbers of drops by increasing the number of drops in two stages by using two threshold values (T1 and T2, D1 and D2) have been exemplified. However, it is also acceptable that the numbers of drops are changed by in three or more stages by using additional threshold values similar to the examples described above.

Furthermore, in the various embodiments described above, the case of discharging one ink drop from the nozzle (105) by using the discharging waveform shown in FIG. 4 has been exemplified. However, other waveforms can also be used as the discharging waveform. As another waveform, for example, the one shown in FIG. 11 can be adopted. The waveform shown in the diagram, in addition to the expansion pulse P1, the ground potential (pulse pause) P2, the shrinkage pulse P3 and the ground potential (pulse pause) P4 include the shrinkage (contraction) pulse P5 for the shrinkage of the volume of the pressure chamber (103) and the ground potential (pulse pause) P6 for returning from the shrinkage of the volume of the pressure chamber (103) by the shrinkage pulse P5 to the steady state, in sequence. In such an arrangement, the sum of the periods of the expansion pulse P1, the ground potential P2 and the shrinkage pulse P3 may be, for example, less than the half value (called AL) of the intrinsic vibration period of the ink, and the time difference from the center of the period from the starting point of the expansion pulse P1 to the end point of the shrinkage pulse P3 to the center of the shrinkage pulse P5 is less than 2AL. In doing so, the residual vibration inside the pressure chamber (103) caused by the ink discharge is suppressed, the ink discharging performance is improved, and the picture quality can be further improved.

Figure 11:
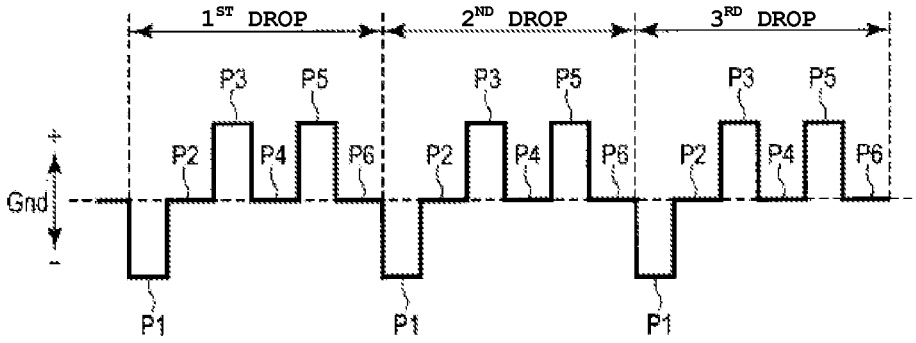
FIG. 11 is a diagram showing the discharging waveform according to a modified example.

Also, in the discharging waveform shown in FIG. 11, the number of shrinkage pulses may be further increased above the number depicted.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head comprising:

a pressure chamber for storing and pressurizing ink;

an actuator for changing the volume of the pressure chamber according to a discharging waveform;

a nozzle for discharging ink stored inside the pressure chamber when the volume of the pressure chamber is decreased by the actuator in response to a discharge cycle in the discharging waveform;

a temperature sensor for detecting a temperature of the ink; and a controller for providing the discharging waveform for controlling the actuator;

wherein:

the controller sets a number of the discharge cycles in the discharging waveform to a first number based on a gradation value of a pixel to be printed when an elapsed time interval between the discharging of ink is less than a first specified time interval, the controller sets the number of discharge cycles in the discharging waveform to a second number greater than the first number when the elapsed time interval between the discharging of ink is greater than the first specified time interval, and the first specified time interval is set to be more than a reference time interval if the detected temperature of the ink is more than a reference temperature, and the first specified time interval is set to be less than the reference time interval if the detected temperature of the ink is less than the reference temperature.

2. The inkjet head according to claim 1, wherein the elapsed time interval is measured in units of time.

3. The inkjet head according to claim 1, wherein the elapsed time interval is measured in the number of pixels between ink discharges.

4. The inkjet head according to claim 1, wherein when the elapsed time interval is greater than a second specified interval which is greater than the first specified interval, the controller sets the number of discharge cycles in discharging waveform to a second number greater the first number.

5. The inkjet head according to claim 1, wherein the actuator comprises a piezoelectric element connected to the controller and a vibration plate forming a wall of the pressure chamber for storing the ink.

6. The inkjet head according to claim 1, further comprising:

a plurality of pressure chambers for storing ink, each pressure chamber having a respective nozzle.

7. The inkjet head according to claim 1, wherein the discharged cycle includes an expansion pulse for expanding the volume of the pressure chamber, a ground potential pulse, and a plurality of contraction pulses for reducing the volume of the pressure chamber.

8. The inkjet head according to claim 1, further comprising:

a conveying device for conveying a recording medium to a position for the ink to discharge from the nozzle and form a picture image thereon.

9. A method for controlling an inkjet head that dispenses ink drops to a recording medium, comprising:

determining an elapsed time interval between ink discharges from a nozzle;

determining whether the interval is greater than a first specified interval;

when the elapsed interval is not greater than the first specified interval, setting a first number of discharge cycles in a discharge signal to be supplied to an actuator controlling the dispensing of ink drops from the nozzle in accordance with a gradation value determined for a pixel to be printed;

when the elapsed interval is greater than the first specified interval, setting the number of discharge cycles in the discharge signal to be supplied to the nozzle to include one or more discharge cycles more than the first number;

detecting a temperature of the ink supplied for discharge from the nozzle; and determining whether the detected temperature of the ink is greater than a reference temperature, wherein the first specified time interval is set to be more than a reference time interval if the detected temperature of the ink is more than the reference temperature, and the first specified time interval is set to be less than the reference time interval if the detected temperature of the ink is less than the reference temperature.

10. The method of claim 9, wherein the elapsed time interval is determined by reference to a timer.

11. The method of claim 9, wherein the elapsed time interval is determined by reference to a number of zero drop pixels between ink discharges.

12. The method of claim 9, further comprising:

supplying the discharge signal to the nozzle.

13. The method of claim 9, further comprising:

determining whether the elapsed time interval is greater than a second specified interval, the second specified interval being greater than the first specified interval;

when the elapsed time interval is greater than the second specified interval, setting the number of discharge cycles in the discharge signal to be supplied to the nozzle to include one or more discharge cycles more than the number set when the interval is greater than the first specified interval.

14. The method of claim 13, wherein the elapsed time interval is determined by reference to a timer.

15. The method of claim 13, wherein the elapsed time interval is determined by reference to a number of zero drop pixels between ink discharges.

16. A non-transitory computer readable medium storing a computer program which when executed causes a controller connected to an inkjet head to perform steps comprising:

determining an elapsed time interval between ink discharges from a nozzle;

determining whether the elapsed time interval is greater than a first specified interval;

detecting a temperature of the ink supplied for discharge from the nozzle;

determining whether the detected temperature of the ink is greater than a reference temperature;

when the elapsed time interval is not greater than the first specified interval, setting a first number of discharge cycles in a discharge signal to be supplied to an actuator controlling the dispensing of ink drops from the nozzle in accordance with a gradation value determined for a pixel to be printed; and when the elapsed time interval is greater than the first specified interval, setting the number of discharge cycles in the discharge signal to be supplied to the nozzle to include one or more discharge cycles more than the first number, wherein the first specified time interval is set to be more than a reference time interval if the detected temperature of the ink is more than the reference temperature, and the first specified time interval is set to be less than the reference time interval if the detected temperature of the ink is less than the reference temperature.

17. The computer readable medium of claim 16, wherein the elapsed time interval is determined by reference to a timer.

18. The computer readable medium of claim 16, wherein the elapsed time interval is determined by reference to a number of zero drop pixels between ink discharges.

19. The computer readable medium of claim 16, the steps further comprising:

supplying the discharge signal to the nozzle.

* * * * *